United States Patent [19]

Groff

[11] Patent Number: 4,461,383

[45] Date of Patent: Jul. 24, 1984

[54] NECKLACE WRAPPER

[76] Inventor: Horace E. Groff, Box 379, School Rd., Bowmansville, Pa. 17507

[21] Appl. No.: 394,792

[22] Filed: Jul. 2, 1982

[51] Int. Cl.[3] ..... B65D 25/10; B65D 5/50

[52] U.S. Cl. ..... 206/45.14; 206/45.19; 206/44.12; 206/566

[58] Field of Search ..... 206/45.14, 45.19, 45.31, 206/45.34, 44.12, 566; 242/68.5

[56] References Cited

U.S. PATENT DOCUMENTS

| | | | |
|---|---|---|---|
| 1,691,936 | 11/1928 | Peter | 206/565 |
| 2,250,433 | 7/1941 | Dean | 206/45.14 |
| 2,253,212 | 8/1941 | Rathbun | 206/565 |
| 2,962,156 | 11/1960 | Adams | 206/566 |
| 3,650,382 | 3/1972 | Braun et al. | 206/45.14 |
| 3,997,050 | 12/1976 | Patterson | 206/566 |
| 4,016,972 | 4/1977 | Szamborski | 206/45.14 |
| 4,120,394 | 10/1978 | Soltes | 206/45.34 |
| 4,324,446 | 4/1982 | LeSage | 206/45.34 |

FOREIGN PATENT DOCUMENTS

| | | | |
|---|---|---|---|
| 412249 | 7/1910 | France | 206/566 |
| 22800 | of 1914 | United Kingdom | 206/566 |
| 247002 | 2/1926 | United Kingdom | 206/566 |

*Primary Examiner*—William T. Dixson, Jr.
*Assistant Examiner*—Brenda J. Ehrhardt
*Attorney, Agent, or Firm*—Harvey B. Jacobson

[57] ABSTRACT

A necklace wrapping apparatus and method including a necklace supporting, display and storage assembly having a rotating shaft mounted within a box to be used for supporting, displaying and the storage of jewelry, a member fastening a portion of the necklace or similar piece of jewelry to the rotating shaft and wrapping the jewelry around the shaft by the shaft being turned. Use of the method and apparatus provides storage for necklaces or similar pieces of jewelry having the advantage that by reason of the present invention, tangled or knotted chains are eliminated, the necklace is easily stored and quickly available for subsequent use, the necklace is easily removed by grasping and pulling gently on the necklace, and the necklace is attractively displayed for easy selection for a consumer or retailer. Several forms of fasteners are provided on the rotating shaft and cooperating with the closure member of the box is a securing or locking feature holding the shaft firm when the box is closed.

11 Claims, 3 Drawing Figures

NECKLACE WRAPPER

BACKGROUND OF THE INVENTION

1. Field of the Invention

The present invention relates to a jewelry box constructed and arranged for fastening a necklace or similar piece of jewelry to a rotating shaft and wrapping it around the rotating shaft as it is turned.

More particularly, the invention relates to selected various fastening means or members of selected shapes and forms adaptable for displaying, supporting and storing a necklace or similar piece of jewelry in a box and providing a locking feature for holding the rotating shaft firm to secure proper supporting, display and storage of the necklace or similar piece of jewelry.

2. Description of the Prior Art

Various prior art and U.S. patents relating to jewelry cases and their various constructions and arrangements, and of interest to the present invention are the following U.S. Pat. Nos.

1,691,936, H. A. Peter; 2,253,212, M. L. Rathbun; 2,962,156, G. M. Adams; 4,120,394, I. B. Soltes.

The patent to Adams discloses a portable jewel case having a rotatable drum with several resilient cushioned sections for receiving rings. The patent to Rathbun discloses a jewelry case having a circular inset in the form of a ring having spaced apart ends for mounting a strap and watch accordingly. The other patents disclose a belt box and case for carrying a pendant and chain. None of these patents discloses all of the specific details of the present invention in such a way as to bear upon the patentability of any claims of the present invention.

SUMMARY OF THE INVENTION

An object and advantage of the present invention is to provide a jewelry container having a rotatable member mounted therein and for supporting, displaying and storing, a necklace or similar pieces of jewelry.

Another object of the present invention is to provide an assembly and method of rotating a shaft within a jewelry box and the like to be used for support, display and storage of the necklace or similar piece of jewelry that can be secured or fastened to a member on the rotating shaft and wrapped around the shaft as it is turned on its axis. In this way, it is easily possible to eliminate tangled or knotted chains in supporting, displaying and storage of necklaces or similar pieces of jewelry, and in which the necklace and the like is easily removed by grasping and pulling gently on the necklace while the rotating shaft is unwound, and providing an apparatus and method of attractively displaying for easy selection by a retailer of such goods or for selection by a consumer as to choice and wearing of the necklace and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
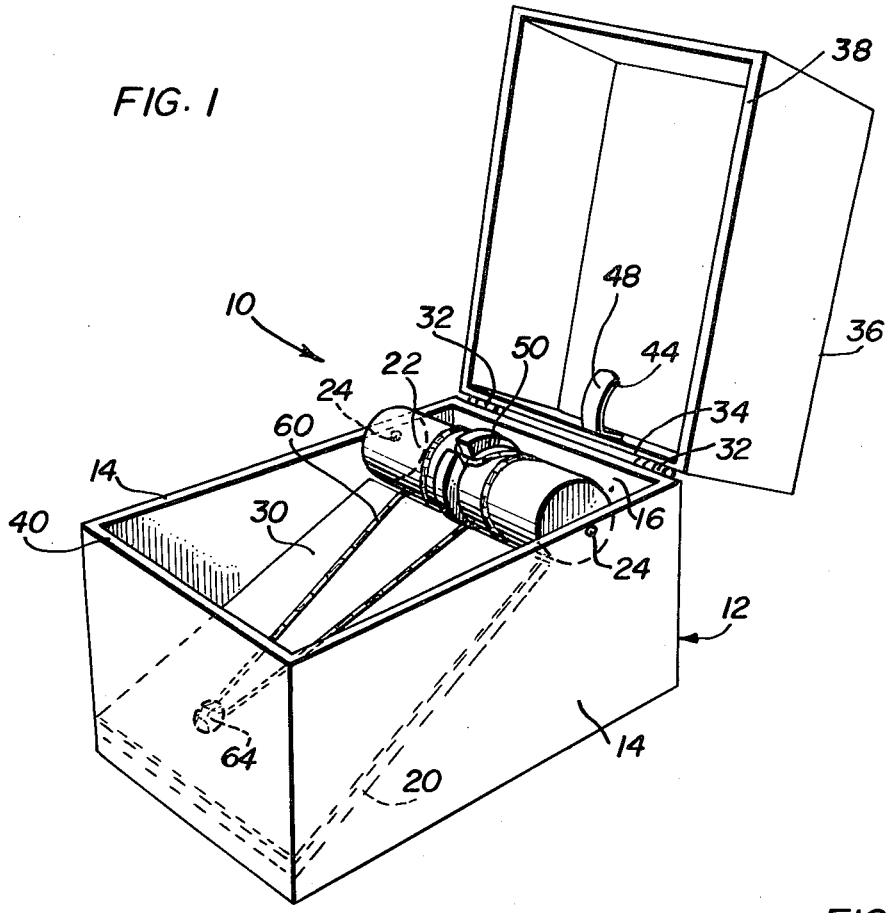
FIG. 1 is a front perspective view of an open jewelry box with rotating shaft and a fastening member thereon according to one embodiment of the invention.

Referring now to the drawings, there is shown a necklace supporting, display and storage assembly 10 including a generally hollow box 12 with a bottom (not shown), two opposite side walls 14, a rear wall 16, a front wall 18, and a display portion or surface 20 extending from the front bottom portion of the box 12 rearwardly and upwardly while contacting each of the opposite side walls 14 until it is proximate to the lower periphery of a rotating shaft 22 mounted by pins or pivots 24 engaging the opposite side walls 14.

Figure 2:
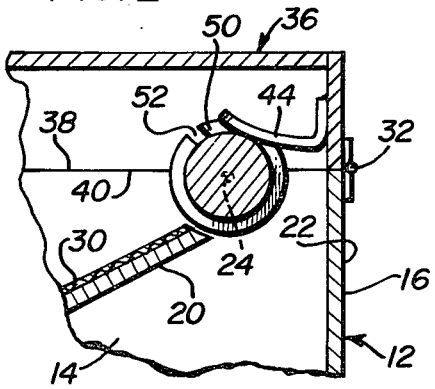
FIG. 2 is a fragmentary sectional view of a rotating shaft within a box showing the details together with a locking feature thereof.

Shown in FIGS. 1 and 2 is a velvet or other decorative layer 30 that covers the inclined member 20. The inclined member 20, the box, as well as the rotating shaft 22 may be constructed of materials such as plastic, wood or other materials.

Along a rear upper surface of the rear wall 16 is a set of spaced hinges 32 having one side secured to the rear wall 16 and the other side of the hinge 32 similarly secured to a lower outer surface 34 of a rear wall of a cover lid 36. The cover lid 36 is also constructed of materials similar to the box as mentioned above and the cover lid 36 may have a recess extending upwardly within the cover lid interior of the engaging surface 38 that engages the free edge 40 of the box 12. The recess in the cover lid 36 is adequate to receive a portion of the diametrical dimension of the shaft 22 and for mounting and allowing the function of a securing or locking member 44 supported by a rivet or fastener (not shown) secured into an inside surface of the rear wall of the cover lid 36 in a conventional manner, the fastener being glue means, screws, a rivet or rivets or the like. The locking member 44 is constructed of material having the nature of resiliency such that when its free end 48 contacts or impacts with a surface of the rotating shaft 22, the characteristic resiliency of the locking member 44 holds the rotating member 22 from vibration, spurious rotation or other movement while the cover lid 36 is closed and until the cover lid is subsequently opened for releasing the tension of the locking member 44 impacting the shaft 22.

In the embodiment of FIG. 1, the rotating shaft 22 is shown having a split ring 50 mounted along an intermediate or middle section of the rotating shaft between its pivoted ends, and the split ring 50 contains a split or recess 52 sufficient for receiving or having inserted therein a portion of a necklace 60, and by rotating the shaft 22 about the pivots 24, the necklace 60 is wound around the rotating shaft 22 until a selected free end 64, which may be a pendant or other decorative device on the necklace 60 is positioned along the display surface 30 supported by the inclined wall 20 shown in FIG. 1.

On closing the cover lid 36, the locking member 44 with its contacting and locking surface 48 engages with a portion of the shaft 22 and retains it in position and applies sufficient frictional force for precluding the shaft 22 from rotation while the cover lid 36 is in place. Accordingly, a fastener (not shown) can be provided along the box proximate the engaging surfaces 38, 40 but as is shown in the drawings, the mere weight of the cover lid 36 provides adequate tension for bias by the locking member 44 upon the shaft 22 precluding it from vibration or rotation about the pivots 24 accordingly.

Figure 3:
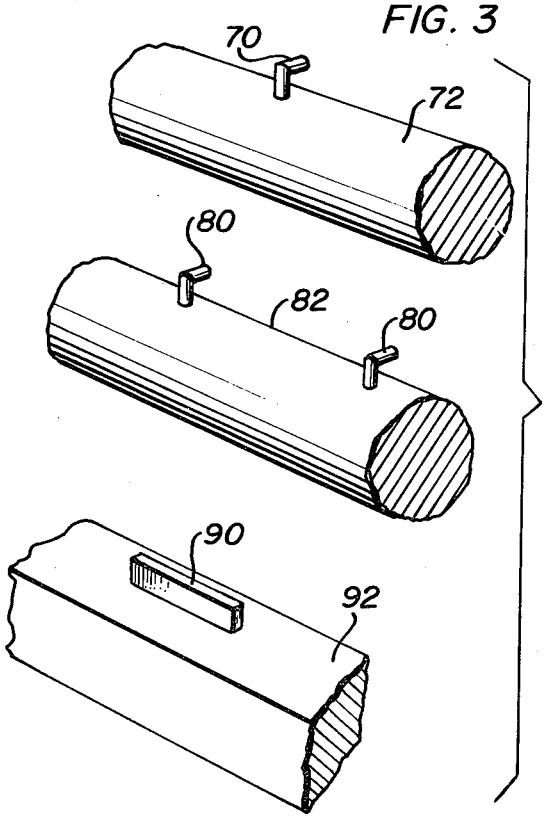
FIG. 3 are fragmentary perspective views of several embodiments of rotating shafts and fastener members thereof.

Other forms of fasteners are shown in FIG. 3 such as a single elbow or hook fastener 70 on a rotating shaft 72, a set of elbow or hook elements 80 on a rotating shaft 82 and a fastener bar 90 provided on a shaft 92 of a generally square cross sectional configuration as shown. These fasteners 70, 80, 90 provide for ease of wrap around in securing a loose bracelet, chain, necklace, or similar piece of jewelry upon the rotating shafts 72, 82 or 92 and thus allow the necklace or similar piece of jewelry to correspondingly be displayed upon the surface material 30 of the inclined member 20 as described above.

The shape and form of the fasteners 50, 70, 80, or 90 are shown as exemplary in form and configuration as disclosed upon a rotating structure or body such as the shaft 22, 72, 82, 92. In each circumstance and embodiment, a similarly constructed locking member or feature may be provided for securing the selection of shafts in a secure or fixed position when the box is closed, the lid 36 engaging with the box 12. In this way, it is significant that use of the arrangement according to the invention provides elimination of tangled or knotted chain or necklace structures or similar pieces of jewelry, and that the arrangement provides for display, support and storage of a necklace or similar piece of jewelry in an attractive and demonstrative fashion that is easily provided and quickly available and still retains the arrangement in an organized fashion in storage. The necklace also is easily removed from the rotating shaft by grasping the necklace easily and pulling gently on the necklace as the rotating shaft unwinds until the necklace is removed from engagement with the fasteners 50, 70, 80, 90.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A necklace supporting, display and storing assembly comprising a necklace box having a base with upstanding side, front and rear walls, a rotatably mounted roller supported within the necklace box for rotation about a horizontal axis, fastening means disposed on the roller for receivably fastening a portion of a necklace onto the roller, means defining a necklace support surface in the box with a gap between the support surface and the roller enabling a necklace to be wrapped around the roller by rotation of the roller, with a portion of the necklace being disposed on the support surface, the box further being provided with a lid including resilient locking means for engaging the roller when the lid is in closed position for biasing the roller against rotation about its axis when the lid is closed upon the box.

2. The invention of claim 1 wherein said display surface has one edge proximate the surface of the roller and the surface extending in an inclined downwardly direction toward a bottom front side of the box as it engages each opposite wall thereof.

3. The invention of claim 1 wherein the fastener means is comprised of a split ring fixedly mounted about a midportion of the roller.

4. The invention of claim 1 wherein the fastener means is at least one hook means and being mounted long a midportion of the roller.

5. The invention of claim 1 wherein the fastener means is an elongated bar mounted on a roller having a generally square configured cross section.

6. A necklace wrapping, support, displaying and storage arrangement comprising a method of utilizing a hollow box, the box having a hinged recessed cover lid hingedly supported from about a rear portion of the box, a rotating shaft mounted on pivots within the box and the pivots engaging interior surfaces of opposite side walls of the box, the inclined surface extending from a lower front portion of the box generally outwardly and rearwardly toward the rotating shaft and the inclined surface providing a display for the necklace, the rotating shaft having fastening means along a midportion of the shaft for receiving in engagement therewith a portion of the necklace, the necklace then being wrapped around the rotating shaft for several turns and having a terminal portion of the necklace hanging along the inclined surface for display, support and storage.

7. The invention of claim 6 wherein there is further provided locking means securing the rotating shaft from rotation when the lid cover is in closed relation with the box.

8. The invention of claim 6 wherein further is the method of recouping the necklace upon opening the box and upon grasping and gently pulling the necklace, the necklace is unwound from the rotating shaft and is removed from the support, display and storage provided thereby.

9. A necklace support, display and storing assembly comprising a necklace box having a base with upstanding side, front and rear walls, means defining a necklace support surface in the box, a roller supported in the box for rotation about a horizontal axis, the roller being located in juxtaposition to the support surface, fastening means on the roller for receivably fastening a portion of a necklace onto the roller, and a necklace fastened on the fastening means, the necklace being wrapped around the roller by rotation of the roller and a portion of the necklace being disposed on the support surface.

10. The invention of claim 9 wherein the roller is disposed adjacent one edge of the support surface with a gap between the one edge of the surface and the periphery of the roller, the surface being inclined downwardly from said one edge toward the front wall of the box.

11. The invention of claim 9 wherein the box has a hinged lid with resilient locking means therein for engaging the roller when the lid is closed for biasing the roller against rotation.

* * * * *